United States Patent [19]

Ho

[11] Patent Number: 4,979,661

[45] Date of Patent: Dec. 25, 1990

[54] LIE-IN TAPE DISPENSER

[76] Inventor: Jackson Ho, 1st Fl., 17, Lane 10, Chung Shan Road, Sec. 2, Panchiao City, Taiwan

[21] Appl. No.: 457,522

[22] Filed: Dec. 27, 1989

[51] Int. Cl.[5] ..... B26D 1/02

[52] U.S. Cl. ..... 225/39; 225/88

[58] Field of Search ..... 225/88, 77, 25, 26, 225/39, 42, 48, 19; 206/214, 224, 411, 371

[56] References Cited

U.S. PATENT DOCUMENTS

| | | | |
|---|---|---|---|
| Re. 23,129 | 6/1949 | Borden | 225/77 |
| 1,892,544 | 12/1932 | Wanders | 225/88 |
| 3,489,324 | 1/1970 | Stohl | 225/42 |
| 4,320,835 | 3/1982 | Polhemus et al. | 206/411 |
| 4,493,446 | 1/1985 | Wirth | 225/21 |

*Primary Examiner*—Douglas D. Watts
*Assistant Examiner*—John M. Husar
*Attorney, Agent, or Firm*—Bacon & Thomas

[57] ABSTRACT

A lie-in tape dispenser, which includes a base having a column upstanding therefrom for the mounting thereon of an adhesive tape in a horizontal position, an upper cover which is pivoted to the base comprising a rectangular recess and circular recess on its upper surface for receiving a variety of writing materials. The adhesive tape can be pulled out from the column, with its non-adhesive side in contact with the wall surface of an U-shaped opening on the base for angle change through a pressure board thereon to a cutter holder for cutting by a cutter.

3 Claims, 4 Drawing Sheets

LIE-IN TAPE DISPENSER

BACKGROUND OF THE INVENTION

The present invention relates to a tape dispenser for the mounting and dispensing of an adhesive tape.

In conventional tape dispensers, an adhesive tape roll is commonly placed on a dispenser in a vertical position. This utilizes much more space that the space of a tape dispenser can not be fully utilized.

SUMMARY OF THE INVENTION

The present invention provides an improvement in the structure of a tape dispenser so that an adhesive tape roll can be horizontally mounted on a tape dispenser, and the space of such a tape dispenser can be fully utilized for receiving a variety of writing materials. Through an U-shaped opening and a narrow channel on a base, a tape which is horizontally mounted on a column of such a base can be pulled out and turned to a right direction toward a cutter holder for cutting by a cutter. Therefore, an upper cover which has rectangular and circular recess holes thereon can be pivotally secured to such a base for conveniently receiving a variety of writing materials with minimized space occupation.

The present invention also provides a multipurpose lie-in tape dispenser which includes a base having a column upstanding therefrom for the horizontal mounting of an adhesive tape roll. A special mechanism is made on the base permitting the adhesive tape to change its direction when it is pulled out to a cutter for cutting An upper cover which comprises a rectangular recess and a circular recess for receiving a variety of writing materials is pivoted to the base.

Figure 1:
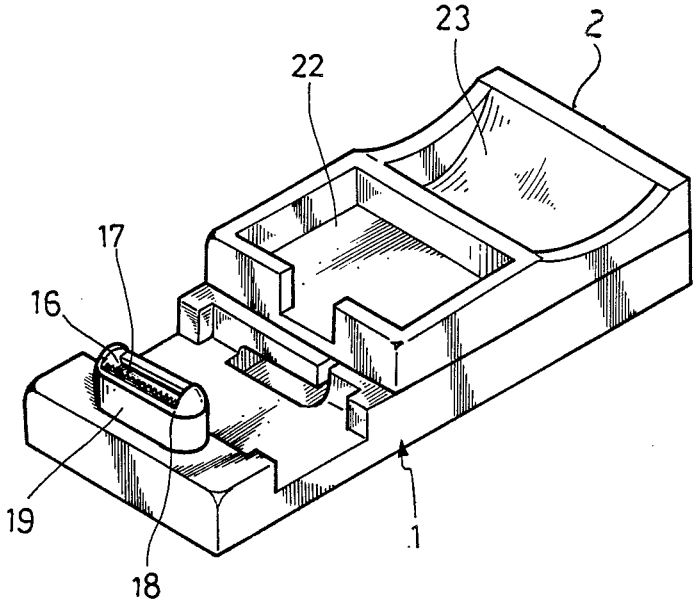
FIG. 1 is a perspective view of a lie-in tape dispenser embodying the present invention.
Figure 2:
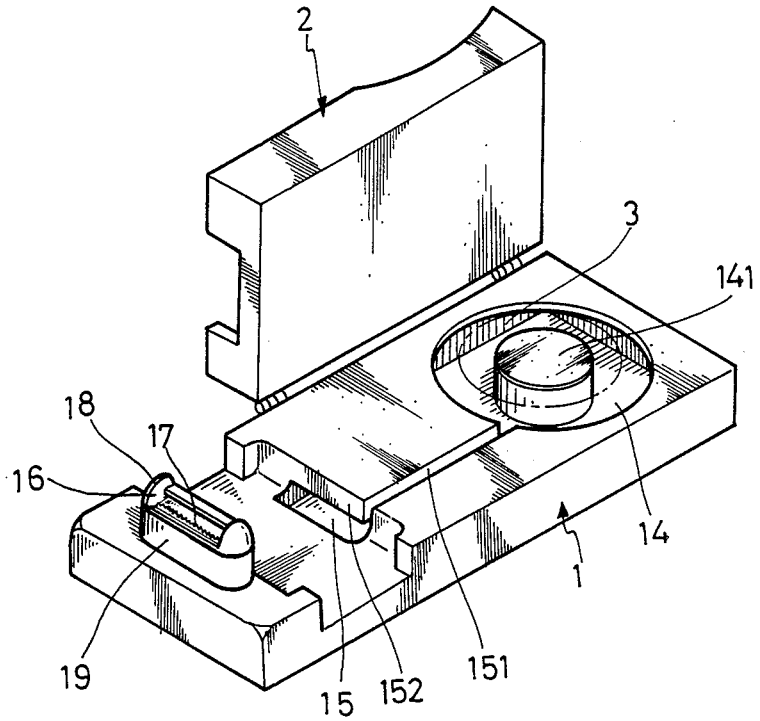
FIG. 2 is a perspective view of the lie-in tape dispenser of FIG. 1, in which its upper cover is lifted.
Figure 3:
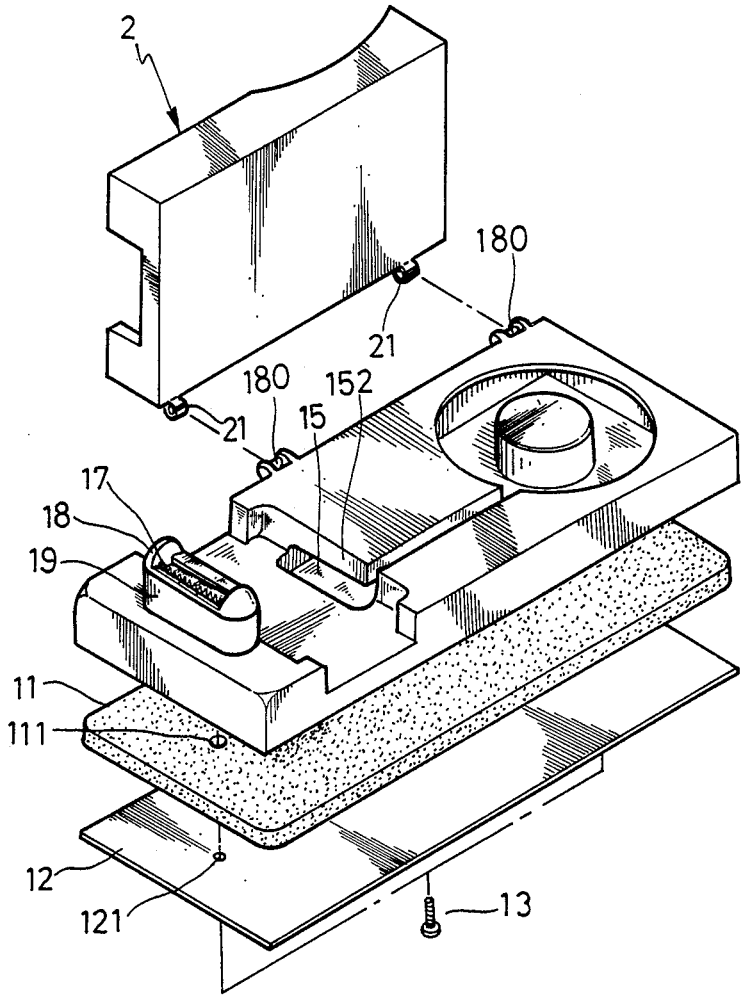
FIG. 3 is a perspective exploded view of the lie-in tape dispenser of FIG. 1.
Figure 4:
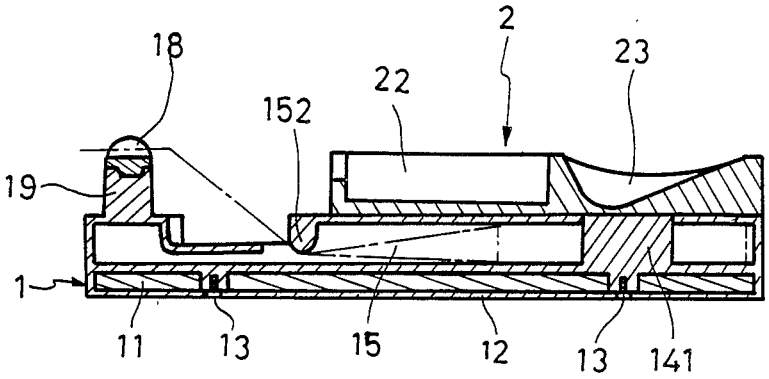
FIG. 4 is a sectional elevation of the lie-in tape dispenser of FIG. 1.

DETAILED DESCRIPTION OF THE PREFERRED EMBODIMENT:

Referring to FIGS. 1 through 4, there is a lie-in tape dispenser in accordance with the present invention which includes a base (1) having a cast iron board (11) and a bottom board (12) respectively attached thereto at its underbottom. As illustrated, the cast iron board (11) and the bottom board (12) have holes (111) and respectively, formed therein for receiving screw bolts (13) to secure same to the base (1). A circular recess (14) is made on the base (1), which comprises a column (141) upstanding therefrom for the mounting thereon of an adhesive tape roll (2) in a horizontal position. An U-shaped opening (15) is made on the base (1) and extends from the circular recess (14) defining therewith a narrow channel (151) and a pressure board (152). After the adhesive tape (3) is mounted on the column (141) in the circular recess (14), the front end of the adhesive tape (3) can be pulled out to extend from one edge of the pressure board (152) obliquely through the channel (151) into the U-shaped opening (15) to further come out of the U-shaped opening (15) from an opposite edge of the pressure board (152) through a notch (16) of a cutter holder (18) mounted on a seal (19) for cutting by a cutter (17). When the adhesive tape (3) is pulled out to the cutter holder (18) for cutting, its non-adhesive side shall be attached to the surface of the pressure board (152) for convenient operation. There is an upper cover (2) pivoted to the base (1). The upper cover (2) comprises two pin holes (21) bilaterally disposed at its one side for securing to a pair of pin holders (180) which are made on the base at its one side, such that the upper cover (2) can be pivotally secured to the base (1) to expose or cover same. The upper cover (2) further comprises a rectangular recess (22) and a circular recess (23) on its upper surface for receiving clips, memo-paper and some other writing materials.

Figure 5:
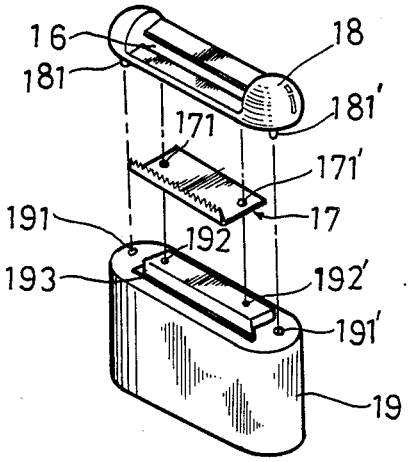
FIG. 5 illustrates the structure of the cutter, the cutter holder and the seat.

With particular reference to FIG. 5 cutter (17) comprises two convex portions (171) and (171') respectively set in two corresponding concave portions 192) and (192') which are made on a seat (19) on the base (1). The cutter holder (18) comprises two bottom pins (181) and (181') respectively inserted in two pin holes (191) and (191'), which are made on the seat (19), to firmly retain the cutter (17) therebetween, thereby permitting the cutting edge of the cutter (17) to protrude upwardly from a groove (193) on the seat (19). Through this arrangement, the ©utter (17) can be very conveniently replaced with a new one when it is damaged or becomes dull.

What is claimed is:

1. A lie-in tape dispenser comprising:

(a) a base having a hollow bottom, a bottom board and a cast iron board, the bottom and cast iron boards being secured to the hollow bottom of the base;

(b) a circular recess formed in the base and a column extending upwardly from the bottom of the recess for supporting a roll of adhesive tape in a horizontal position and permitting the tape to be unrolled therefrom in a vertical position;

(c) portions of the base forming a U-shaped opening extending from the circular recess and defining therewith a narrow channel and a pressure board for receiving the tape from the roll in the vertical position and twisting same into a horizontal position for dispensing from the U-shaped opening on the underside of the pressure board;

(d) a seat provided on the base, a cutter supported on the seat and a cutter holder detachably securing the cutter to the seat for receiving the tape dispensed from the U-shaped opening and cutting same;

(e) a cover having an upper surface, at least one recess formed in the upper surface for receiving writing materials therein; and (f) cooperating means connecting the cover to the base for pivotal movement of the cover between a first position wherein the cover substantially conceals the circular recess and narrow channel, and a second position wherein the circular recess and narrow channel are exposed.

2. The tape dispenser of claim 1 further including:

(a) a pair of bottom pins extending downwardly from the cutter holder;

(b) a pair of pin holes formed in the seat for detachably receiving the bottom pins therein;

(c) a pair of convex portions extending downwardly from the cutter; and (d) a pair of concave portions formed in the seat for receiving the convex portions therein.

3. The tape dispenser of claim 1 wherein the upper surface of the cover includes a rectangular recess and a circular recess for receiving the writing materials.

* * * * *